US008292197B2

(12) United States Patent
Ballu et al.

(10) Patent No.: US 8,292,197 B2
(45) Date of Patent: Oct. 23, 2012

(54) DEVICE FOR CONTINUOUSLY METERING AND TRANSPORTING A POWDER, THE USE OF THE DEVICE, AND A COATING POWDER SPRAYER INSTALLATION INCLUDING THE SYSTEM

(75) Inventors: Patrick Ballu, Reims (FR); Christophe Pravert, La Tronche (FR)

(73) Assignee: Sames Technologies, Meylan (FR)

( * ) Notice: Subject to any disclaimer, the term of this patent is extended or adjusted under 35 U.S.C. 154(b) by 1320 days.

(21) Appl. No.: 11/401,467

(22) Filed: Apr. 11, 2006

(65) Prior Publication Data

US 2007/0235558 A1 Oct. 11, 2007

(51) Int. Cl.
*B05B 9/00* (2006.01)

(52) U.S. Cl. ..... 239/143; 239/340; 239/344; 239/346; 239/364

(58) Field of Classification Search ..... 239/142–144, 239/340, 344, 346, 349, 351, 354, 361, 364–369, 239/373, 654; 222/195, 263
See application file for complete search history.

(56) References Cited

U.S. PATENT DOCUMENTS

| | | | | | |
|---|---|---|---|---|---|
| 3,134,513 | A | * | 5/1964 | Ashman | 406/138 |
| 3,711,022 | A | * | 1/1973 | Witte | 239/708 |
| 4,586,854 | A | * | 5/1986 | Newman et al. | 406/153 |
| 4,660,772 | A | * | 4/1987 | Rice | 239/704 |
| 4,953,792 | A | * | 9/1990 | Evans | 239/654 |

FOREIGN PATENT DOCUMENTS

| | | |
|---|---|---|
| EP | 0 297 463 A1 | 1/1989 |
| EP | 0 864 849 A1 | 9/1998 |
| WO | WO 01/58598 A1 | 8/2001 |

* cited by examiner

*Primary Examiner* — Christopher Kim
(74) *Attorney, Agent, or Firm* — Browdy and Neimark, PLLC

(57) ABSTRACT

A system for continuously metering and transporting a powder comprises means (104-107) for fluidizing ($F_2$) the powder in a closed reservoir (4), a tube (110) dipping into the fluidized powder ($L_4$) and discharging (110B) to the outside of the reservoir (4), and means ($S_2$, $C_2$) for pressurizing the reservoir. The system further comprises supply means ($C_3$) for continuously supplying pressurizing gas from the reservoir (4) to a chamber ($V_6$) for mixing the gas with fluidized powder leaving the tube (110), said supply means ($C_3$) being equipped with or constituting a constriction ($R_3$) to the flow of the pressurizing gas. A hose (7) for transporting the powder mixed with the pressurizing gas is connected to the downstream end of the mixing chamber ($V_6$).

13 Claims, 6 Drawing Sheets

DEVICE FOR CONTINUOUSLY METERING AND TRANSPORTING A POWDER, THE USE OF THE DEVICE, AND A COATING POWDER SPRAYER INSTALLATION INCLUDING THE SYSTEM

The invention relates to a system for continuously metering and transporting powders, to the use of the system, and to a coating powder sprayer installation including the system.

In the field of spraying coating powders, it is known to supply a pneumatic or rotary sprayer with coating powder from a tank in which the coating powder is fluidized with air, whereas a dip tube penetrates the fluidized powder bed and a Venturi aspiration system is mounted on the upper portion of the dip tube which allows to aspirate a portion of the fluidized powder. The tank may be vibrated to improve fluidization. This type of equipment can achieve only a low powder flowrate and limited powder transportation distances, which may compromise certain applications. Moreover, contact of certain essential portions of the equipment with the coating powder to drive movement of the powder results in premature wear of those portions, as a consequence of which the value of the powder flowrate obtained tends to drift. As a result of this, the powder flowrate supplied to the sprayer cannot really be guaranteed, and costly and time-consuming preventive maintenance operations must be undertaken.

To remedy those flowrate and transportation distance limitations, it is known in this field to use a closed reservoir that is supplied sequentially with powder and in which the coating powder is fluidized and conveyed to the sprayer by discharging it into a pipe whose mouth faces a drive air ejector. The function of this ejector is to pressurize the closed reservoir and to meter the powder to be transported. The ejector is sometimes placed directly in the powder bed, as in the Applicant's CSV216 equipment. It may equally be placed close to the mouth of the tube, in which case the powder is aspirated via a dip tube. That type of equipment eliminates the flowrate and transportation distance limitations referred to above but does not provide a complete remedy to wear of certain portions because of the presence of an ejector. Furthermore, control of the powder flowrate over a wide range is not a simple matter.

A pressurized pot as described in FR-A-1 279 167 may be used to transport a powder continuously, at a high flowrate and over long distances, without using a Venturi system subject to fast wear. However, in this system, no control of the product flowrate can be implemented, this flowrate varying as the pot is emptied, since it is difficult to control both the air flowrate necessary to fluidize the powder and the pressure inside the pot. It is also difficult to maintain the coating powder in the fluidized state ready for use without starting to pressurize the pot and discharge the powder. Moreover, to limit head losses in the flow, the dip tube and the pipes to which it is connected must have a relatively large diameter if the powder is to be transported over a long distance, of the order of several meters, and at a high flowrate.

EP-A-1 454 675 discloses the use of a pressurized pot to supply a sprayer with dense fluidized coating powder. The powder flowrate supplied to the sprayer may be controlled by establishing and controlling the pressure in the pot, in particular by means of a vent to the atmosphere. An independent air injector system is provided for stopping the flow of the air/powder mixture and cleaning the sprayer supply pipe when necessary. That kind of equipment and the dense transportation method cannot be used to supply a sprayer over a long distance and are incompatible with successive stopping and restarting of supply.

The above problems arise in any system for continuously metering and transporting powders, for example systems for transporting food, pharmaceutical, or agricultural powders.

In these applications, as in the field of coating powder sprayer installations, it is often important to transport a powder continuously, i.e. without pulsations or sudden fluctuations liable to compromise the operation of the equipment being supplied with the powder, as well as controlling the powder flowrate and avoiding the systematic use of pipes of large diameter, which is not always compatible with the applications envisaged, in particular when supplying mobile equipments.

On these lines, the invention relates to a system for continuously metering and transporting powder from a closed reservoir, the system comprising means for fluidizing at least a portion of the powder in the reservoir, a tube dipping into the fluidized powder and discharging to the outside of the reservoir, and means for pressurizing the reservoir. This system is characterized in that it further comprises supply means for continuously supplying gas for pressurizing the reservoir to a chamber for mixing the gas with the fluidized powder leaving the tube, the supply means being equipped with or constituting a constriction to the flow of the pressurizing gas, and a hose for transporting the powder mixed with the gas is connected to the downstream end of the mixing chamber.

Thanks to the invention, the head loss induced by the constriction on the path of the pressurizing gas to the mixing chamber establishes a pressure difference between the pressure inside the reservoir and the pressure in the mixing chamber. This pressure difference is in fact applied across the dip tube, with the result that it determines the fluidized powder flowrate in the tube when the density of the powder is controlled in the region in which the dip tube is in contact with the powder. In other words, determining, and where applicable controlling, the head loss caused by the pressurizing gas supply means can be used to control the fluidized powder flowrate in the dip tube if the density of the powder is controlled. Reinjecting the pressurizing gas into the mixing chamber at the outlet of the dip tube means that the fluidized powder can be diluted at will by adjusting the pressurizing gas flowrate and/or the constriction. Diluting the powder by addition of gas in this way facilitates its continuous transportation at a high flowrate over large distances.

The invention also relates to a particular use of the system referred to above and more specifically its use to supply a sprayer with coating powder.

The invention further relates to a coating powder sprayer installation that comprises a coating powder sprayer and a system as defined above for supplying the sprayer with coating powder. An installation of the above kind is easier to install and operate than prior art installations and the quality of the coating obtained is improved because the coating powder flowrate can be controlled sufficiently accurately to optimize the operation of the sprayer.

The invention can be better understood and other advantages of the invention become more clearly apparent in the light of the following description of one embodiment of a coating powder sprayer installation of the invention and of seven embodiments of a powder transportation system of the invention, which description is given by way of example only and with reference to the appended drawings, in which.

Figure 1:
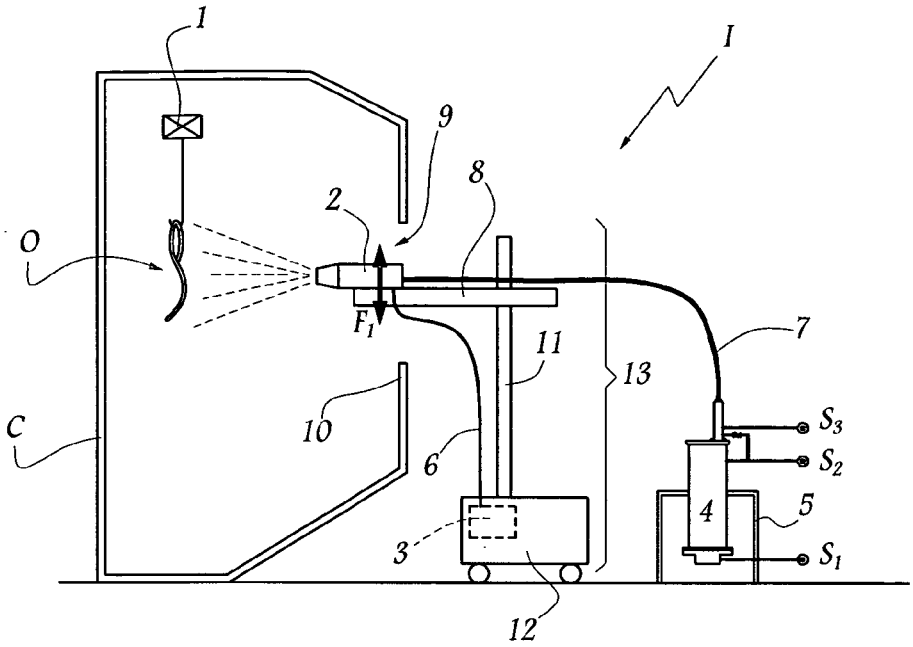
FIG. 1 is a diagram of a coating powder sprayer installation of the invention incorporating a powder transportation system of the invention.

The installation I shown in FIG. 1 is for electrostatically coating objects O moved by a conveyor 1 in a direction perpendicular to the plane of FIG. 1. The objects O pass in front of an electrostatic coating powder sprayer 2 connected to a high-tension unit 3 and supplied with coating powder from a pressurized pot 4 held by a support 5.

The sprayer 2 is connected to the HT unit 3 by an HT cable 6 and to the pot 4 by a hose 7. The sprayer 2 is mounted on an arm 8 extending through a window 9 in a wall 10 of a coating booth C. The arm 8 is movable vertically, as shown by the double-headed arrow $F_1$, and supported by a mast 1 extending vertically from a base 12 of a reciprocator 13.

In operation, a cloud of coating powder is directed from the sprayer 2 towards the objects O along the electrostatic field lines.

Alternatively, the sprayer may not be of the electrostatic type, in which case the path of the powder constituting the coating powder is determined essentially by pneumatic and gravitational forces.

The path of the hose 7 varies in time because of the vertical movement of the arm 8 and the hose cannot have too large a diameter if it is not to impede movement of the mobile portion of the reciprocator.

Figure 2:
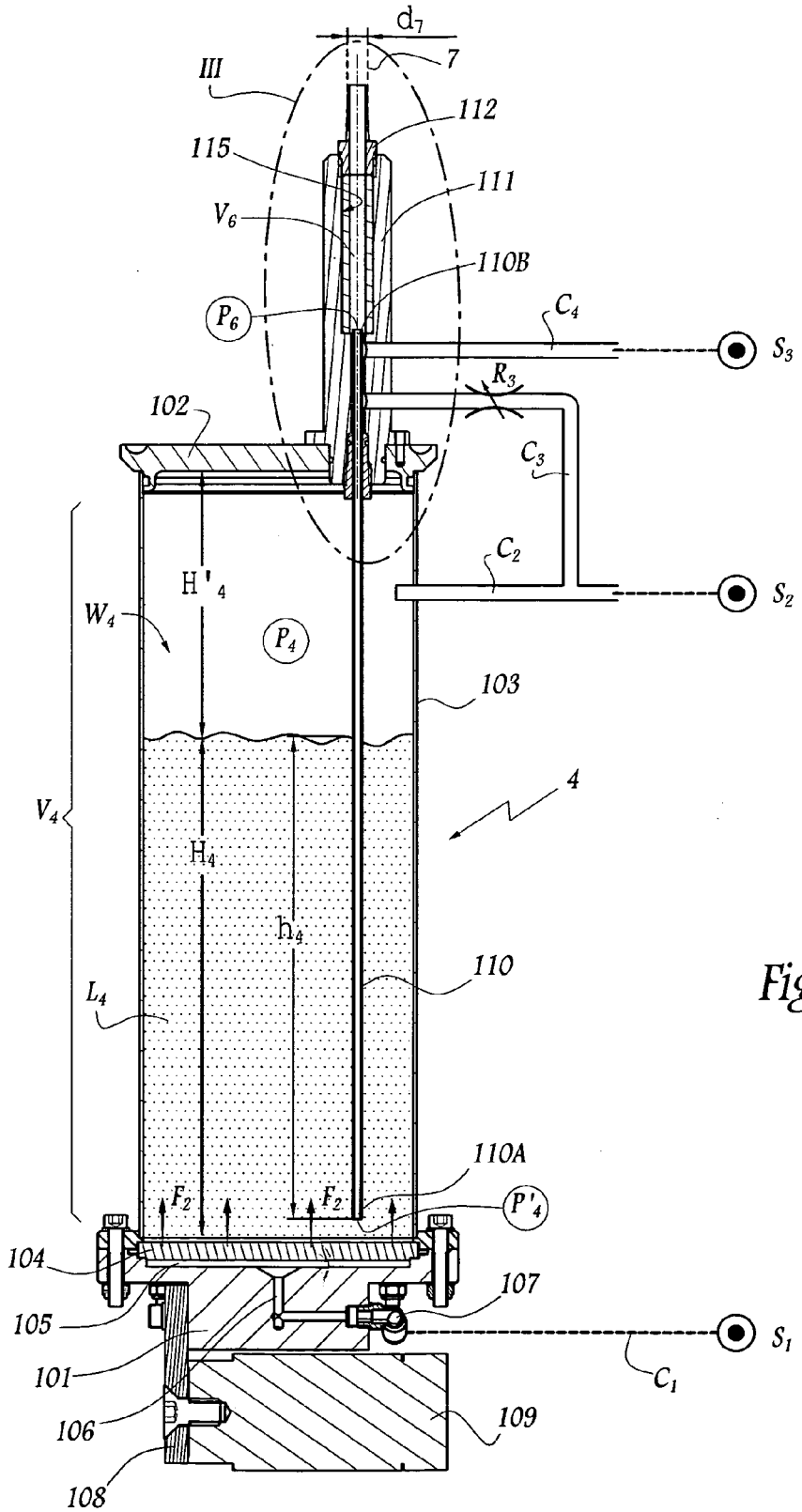
FIG. 2 is a view in longitudinal section and to a larger scale of the transportation system used in the FIG. 1 installation.
Figure 3A:
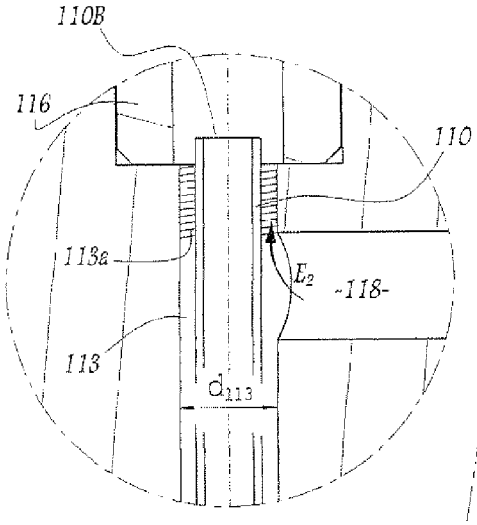
FIG. 3A shows to a still larger scale, a detail of the transportation system portion shown in FIG. 3.
Figure 3:
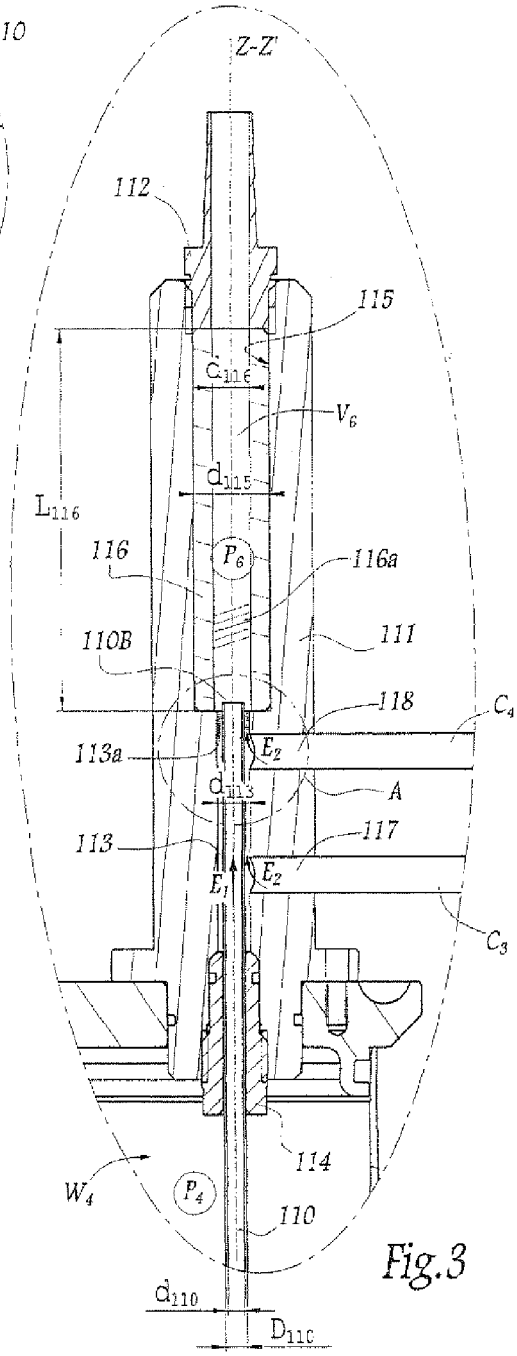
FIG. 3 shows to a larger scale the detail III from FIG. 2.

As seen in FIGS. 2 and 3 in particular, the pressurized pot 4 has a bottom 101 and a lid 102 between which extends a cylindrical wall 103 with a circular section. When the lid 102 is in place on the wall 103, the pot 104 constitutes a reservoir that is sealed from the outside environment.

The bottom 101 is equipped with a porous plate 104 above a distribution chamber 105 supplied with air at a controlled pressure or with a controlled flowrate by a pipe 106 in the bottom 101 discharging to the outside via a connector 107 to which is connected a pipe $C_1$ supplied with compressed air by a regulated compressed air supply $S_1$.

A plate 108 fixed to the bottom 101 supports a vibrator 109 for transmitting vibrations to the pot 4 as a whole to agitate the fluidized mixture in order to facilitate its fluidization and to prevent the formation of preferential flows in or clumping of the powder.

When the chamber 105 is supplied with compressed air, the air flows through the plate 104, as indicated by the arrows $F_2$, which fluidizes the coating powder in the interior volume $V_4$ of the pot 4 and creates a bed $L_4$ Of fluidized coating powder that extends above the plate 104 to a height $H_4$ that depends on the quantity of coating powder present in the volume $V_4$ and on the pressure and the flowrate of the compressed air supplied to the chamber 105.

A dip tube 110 extends downwards from the lid 102 to the vicinity of the plate 104. It has a relatively small inside diameter $d_{110}$ and passes through the lid 102 inside a sleeve 111 that projects upward from the lid 102 and carries a connector 112 to which the hose 7 is connected.

The tube 110 has a lower end 110A and an upper end 110B.

The upper portion of the tube 110 is inside a central bore 113 of the sleeve 111 which is cylindrical and of circular section and the inside diameter $d_{113}$ of which is strictly greater than the outside diameter $d_{110}$ of the tube 110. A ring 114 around the tube 110 is engaged in the bore 113 to hold the tube 110 in position in the bore 113.

Above the bore 113, the sleeve 111 has a second bore 115 aligned with an axis Z-Z' common to the components 110, 113 and 114 and the diameter $d_{115}$ of which is greater than the diameter $d_{113}$.

The inside diameter $d_{116}$ of a liner 116 in the bore 115 is greater than the diameter $D_{110}$ of the tube 110.

A second pipe $C_2$ connects a compressed air supply $S_2$ to a volume $W_4$ that is a portion of the volume $V_4$ that is not occupied by the fluidized coating powder bed $L_4$, i.e. the portion thereof that lies between the upper surface of the bed $L_4$ and the inside face of the lid 102, on a height H'4.

Because of the supply of compressed air to the volume $W_4$, there is a pressure $P_4$ in this portion $W_4$ of the volume $V_4$ which exerts on the upper surface of the bed $L_4$ a force that tends to expel a portion of the coating powder into the end 110A of the tube 110.

A third pipe $C_3$ connects the supply S to a tap 117 on the sleeve 111 in a direction that is globally radial with respect to the axis Z-Z' and discharges into the bore 113 at a distance from the end 110B.

The pipe $C_3$ has an adjustable constriction $R_3$ that creates a head loss ΔP between its upstream and downstream ends.

There are two different fluid flows to be considered at the upper end 110B of the tube 110. The first flow is a flow of air coming from the pipe $C_3$ via the constriction $R_3$. The second flow is a flow of the mixture of powder and fluidization air rising up the tube 110.

At the end 110B of the tube 110 and in most of the interior volume $V_6$ of the liner 116, there is a pressure $P_6$ which, for simplicity, may be considered to be the pressure in each of the two flows. The pressure $P_6$ depends directly on the flow of the mixture of powder and air downstream of the end 110B of the tube 110, i.e. in the interior volume $V_6$ of the liner 116, the hose 7 and the sprayer 2. The pressure $P_6$ is stable if the flows and usage conditions downstream of the end 110B have stabilized under steady state conditions.

The volume $V_6$ constitutes a chamber in which a flow $E_1$ of fluidized coating powder from the bed $L_4$ is mixed with a flow $E_2$ of gas from the pipe $C_3$.

Considering only the flow $E_2$ of gas through the constriction $R_3$, the constriction induces a head loss ΔP that depends directly on the flowrate of air in the pipe $C_3$ and in the constriction $R_3$. Under steady state conditions, once the reservoir 4 is pressurized, the head losses in the pipe $C_2$ may be considered negligible compared to ΔP. Similarly, the head losses in the portions of the pipe $C_3$ respectively upstream and downstream of the constriction $R_3$ may be considered negligible compared to ΔP, as can the head losses in the annular space inside the bore 113 around the tube 110. In the light of the foregoing remarks, the following equation applies, where $P_4$ is the air pressure in the volume $W_4$ and ΔP depends on the flowrate of gas in the constriction $R_3$:

$$P_4=P_6+\Delta P$$

The pressure $P'_4$ in the fluidized bed $L_4$ in the vicinity of the end 110A of the tube 110 may be estimated as follows:

$$P'_4=P_4+\rho g h_4$$

where ρ is the density of the fluidized bed $L_4$, g is the acceleration due to gravity and $h_4$ is the height of the tube 110 in the bed $L_4$ above the end 110A of the tube 110.

Under the above conditions, the pressure difference $\Delta P_{110}$ between the ends of the tube 110 may be expressed as follows:

$$\Delta P_{110}=P'_4-P_6=P_4+\rho g h_4-P_6=\Delta P+\rho g h_4$$

The pressure difference between the inlet and the outlet of the tube 110 is therefore equal to the pressure difference created by the constriction $R_3$ plus a factor depending on the height of the fluidized bed $L_4$, which factor may be calculated.

Under the above conditions, it is possible to control the pressure difference $\Delta P_{110}$ by controlling the head loss ΔP induced by the flow $E_2$ of gas in the constriction $R_3$, ignoring the variation of the height $H_4$ and on condition that the density ρ is maintained substantially constant.

Controlling the pressure difference $\Delta P_{110}$ enables the mass flowrate of fluidized powder in the tube 110 to be controlled because that flowrate is a one-to-one function of the pressure difference $\Delta P_{110}$, the characteristics of the sprayed powder and the geometrical characteristics of the tube 110. Controlling the mass flowrate of powder is therefore easier in proportion to the degree to which the term ΔP that defines $\Delta P_{110}$ is dominant over the term $\rho g h_4$, which circumvents any variations of the height $H_4$.

To vary the head loss induced by the flow of gas in the constriction $R_3$ and thereby to modify the mass flowrate of powder discharged through the tube 110, it is possible to operate on the gas flowrate in the constriction $R_3$ and/or on the geometry of that constriction in the case of a variable constriction. If the constriction is fixed, controlling the gas flowrate in it controls the flowrate of powder discharged through the tube 110 and conveyed to the sprayer 2.

The volume $V_6$ constitutes a mixing chamber for mixing the flow $E_1$ of fluidized powder and the flow $E_2$ of air from the pipe $C_3$, the fluidized coating powder itself being a mixture of powder and fluidizing air from the chamber 105.

Note that the flow $E_2$ discharges around the end 110B of the tube 110 concentrically with the axis of the tube 110, which regulates the flowrate of the mixture of coating powder and air and prevents sudden fluctuations in the flow downstream of the end 110B.

A second tap 118 optionally provided on the sleeve 111 also discharges into the bore 113. The second tap is connected by a pipe $C_4$ to a compressed air supply $S_3$ and conveys to the vicinity of the end 110B of the tube 110 air for further diluting the air/powder mixture produced in the chamber $V_6$.

The taps 117 and 118 are on the upstream side of the downstream end 110B of the tube 110, which prevents the pipes $C_3$ and $C_4$ from being soiled by preventing unwanted return flow of the powder towards them.

The liner 116 may be interchangeable and its inside diameter $d_{116}$ selected as a function of the inside diameter $d_7$ of the hose 7. In practice, the diameter $d_{116}$ is preferably made substantially equal to the inside diameter $d_7$ of the hose 7.

The bore 113 and/or the liner 116 may be cylindrical with straight generatrices or carry on their inside face a thread or a helical raised pattern to improve the mixing of air and powder by rotational stirring or a Vortex effect. A thread 116*a* is partially represented in chain-dotted line in FIG. 3 on the inside face of the liner 116. Alternatively, as shown in FIG. 3A, a thread 113*a* may be provided in the bore 113, on the upstream side of the end 110B of the tube 110, to achieve a Vortex effect in the flow $E_2$.

The length $L_{116}$ of the liner 116, which is equal to the length of the mixing chamber $V_6$, is at least three times the diameter $d_{116}$ and preferably about ten times that diameter, which enables good homogenization of the air/powder mixture from the tube 110 and the air from the bore 113. If a Vortex effect or rotational stirring is used, the ratio $L_{116}/d_{116}$ may be approximately 5/1.

The invention supplies a continuous mixture of air and coating powder to the sprayer 2 over a long distance and at a high and controlled flowrate, even though the tube 110 and the hose 7 have small diameters and the hose 7 is relatively long and adapted to deform as a function of the movements of the arm 8.

Figure 4:
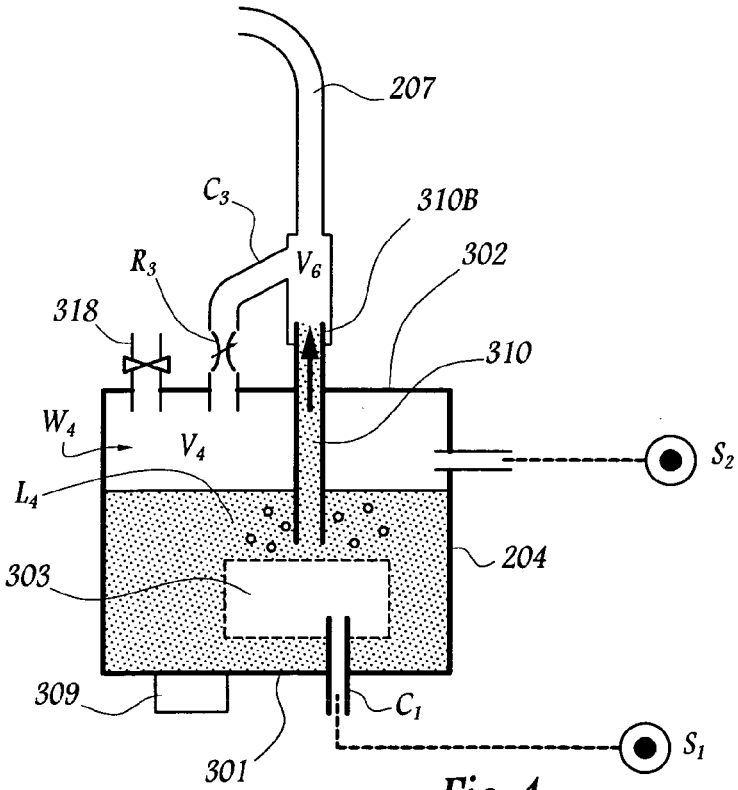
FIG. 4 is a diagram of a second embodiment of a transportation system of the invention.

In a second embodiment of the invention, shown in FIG. 4, components analogous to those of the first embodiment carry the same reference numbers increased by 200. The pressurized pot 204 of this embodiment is equipped with a dip tube 310 that extends from a lid 302 into a bed $L_4$ of coating powder fluidized by a system 303 supplied with fluidizing air by a pipe $C_1$ connected to a compressed air supply $S_1$. A vibrator 309 is mounted on the bottom 301 of the pot 204. The volume $W_4$ of the pot 204 that is not occupied by the fluidized coating powder bed $L_4$ is supplied with compressed air by a pipe $C_2$ connected to a second compressed air supply $S_2$.

The downstream end 310B of the tube 310 discharges into a mixing chamber $V_6$ above the pot 204.

A pipe $C_3$ with an adjustable constriction $R_3$ connects the volume $W_4$ and the mixing chamber $V_6$ through the lid 302; as before, this means that the flowrate of the coating powder/fluidizing gas mixture flowing in the pipe 310 can be controlled by means of the head loss produced by the constriction $R_3$ in the pipe $C_3$.

A vent 318 on the lid 302 vents the volume $W_4$ to the atmosphere, in particular when the equipment to which the pot 204 is connected by a hose 207 is not operating or before it is filled manually with coating powder.

Figure 5:
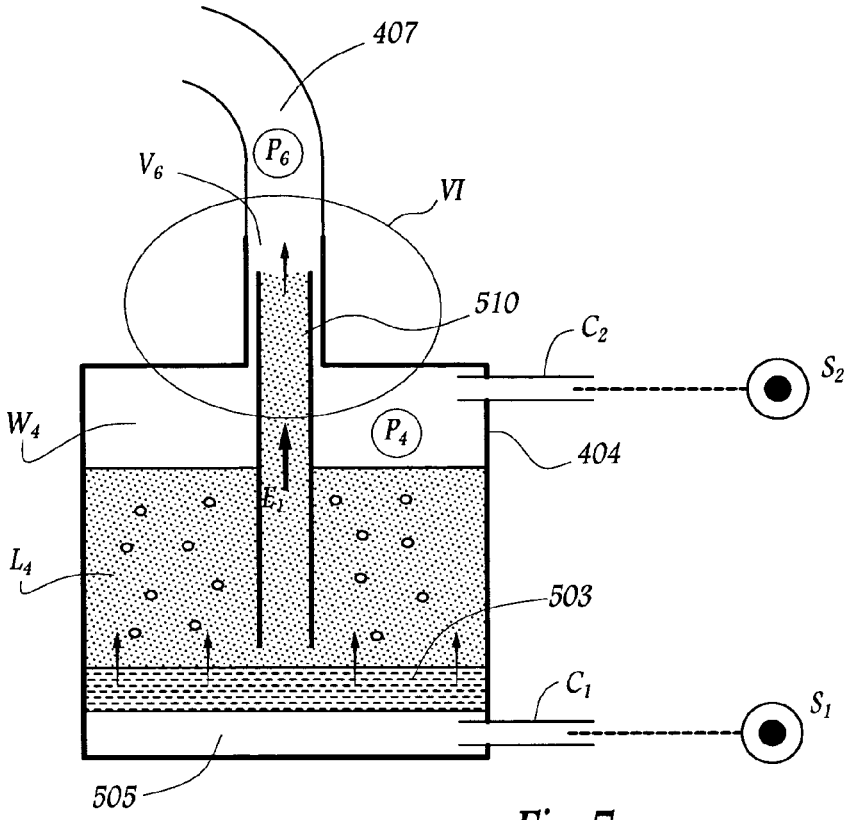
FIG. 5 is a view analogous to FIG. 4 of a third embodiment of a transportation system of the invention.
Figure 6:
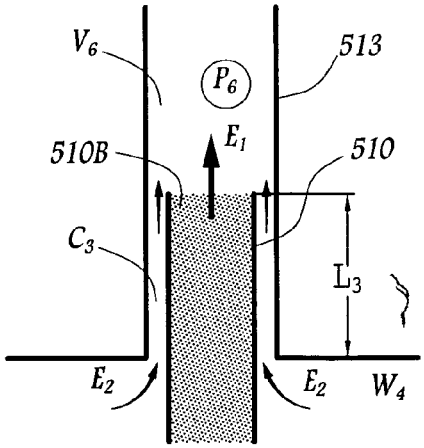
FIG. 6 shows to a larger scale the detail VI from FIG. 5.

In a third embodiment of the invention, shown in FIGS. 5 and 6, components analogous to those of the first embodiment carry the same reference numbers increased by 400. The pressurized pot 404 of this embodiment is equipped with a porous plate 503 supplied with compressed air from a supply $S_1$ via a pipe $C_1$ that discharges into a distribution chamber 505.

A bed $L_4$ of agrofood powder, for example sugar or flour, is therefore produced, leaving a free volume $W_4$ in the upper portion of the pot 404 that is supplied with pressurizing air by a pipe $C_2$ connected to a regulated compressed air supply $S_2$.

A hose 407 connects the pot 404 to a station at which the powder is used (not shown).

$E_1$ denotes the flow of the powder/diluting air mixture in the pipe 510.

As is more particularly clear from FIG. 6, an annular pipe $C_3$ surrounds the upper portion 510B of a tube 510 dipping into the bed $L_4$ and discharging into a sleeve 513. The pipe $C_3$ is produced by the difference between the outside diameter of the tube 510 and the inside diameter of the sleeve 513. This pipe $C_3$ has an annular section whose area is relatively small relative to its length $L_3$, so that of itself it creates a constriction in the flow $E_2$ of pressurizing air between the volume $W_4$ and a mixing chamber $V_6$ in the sleeve 513 downstream of the tube 510. The constriction $R_3$ in the pipe $C_3$ induces a head loss of the same kind as the constriction $R_3$ of the first and second embodiments.

The pressure $P_6$ in the chamber $V_6$ is lower than the pressure $P_4$ in the upper portion of the pot 404 by an amount determined, amongst other things, by the geometry of the pipe $C_3$ and by the flowrate of the gas flowing in the pipe. Accordingly, controlling the flowrate of the gas flowing in the pipe $C_3$ controls the flowrate of the flow $E_1$ of fluidized mixture flowing in the pipe 510. The flowrate of the gas flowing in the pipe $C_3$ in fact depends on the flowrate of the fluidizing gas supplied via the pipe $C_1$ and on the flowrate of the pressurizing gas conveyed from the reservoir 404 by the pipe $C_2$.

If the fluidizing gas flowrate is constant, a substantially constant mass per unit volume of fluidized powder is obtained and the only parameters to be controlled in order to control the powder flowrate in the pipe 510 are the pressure and/or the flowrate of the gas for pressurizing the reservoir via the pipe $C_2$. The constriction formed by the pipe $C_3$ may be designed so that the fluidizing gas flowrate is insufficient of itself to generate flow in the pipe 510, which means that the fluidized powder bed $L_4$ may be continuously fluidized without discharging powder into the pipe 110 and the powder remains instantly available for "pumping" as and when required.

In an embodiment of the invention that is not shown, the section of the pipe $C_3$ or of its inlet region may be adjustable so that the air flowrate in the pipe and therefore the head loss and the flowrate in the tube 510 may be modulated.

Figure 7:
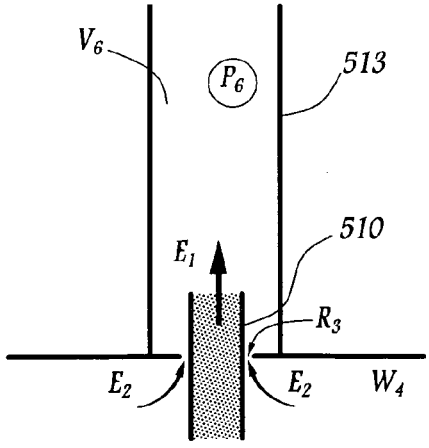
FIG. 7 is a view analogous to FIG. 6 of a fourth embodiment of a transportation system of the invention.

In the FIG. 7 embodiment, the pipe $C_3$ is replaced by an annular constriction $R_3$ around a portion of the dip tube 510. This constriction is sufficient in itself to produce a head loss in the flow $E_2$ of air that results from the difference between the pressure $P_4$ in the volume $W_4$ of the pressurized pot and the pressure $P_6$ in a mixing chamber $V_6$ formed in a sleeve 513 in a manner analogous to that of the third embodiment. The constriction $R_3$ may be fixed or adjustable.

Figure 8:
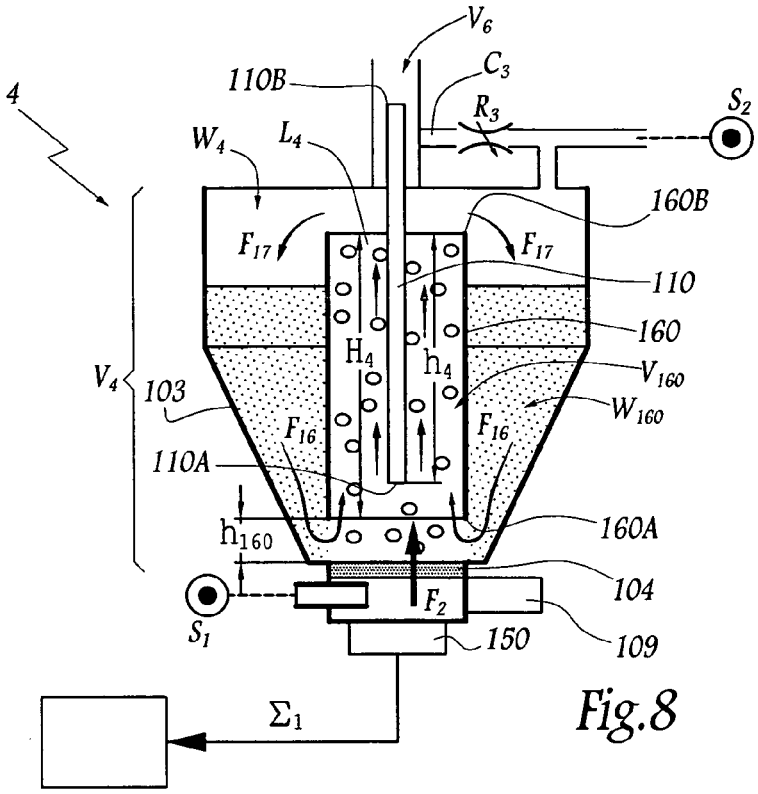
FIG. 8 is a view analogous to FIG. 4 of a fifth embodiment of a system of the invention.
Figure 9:
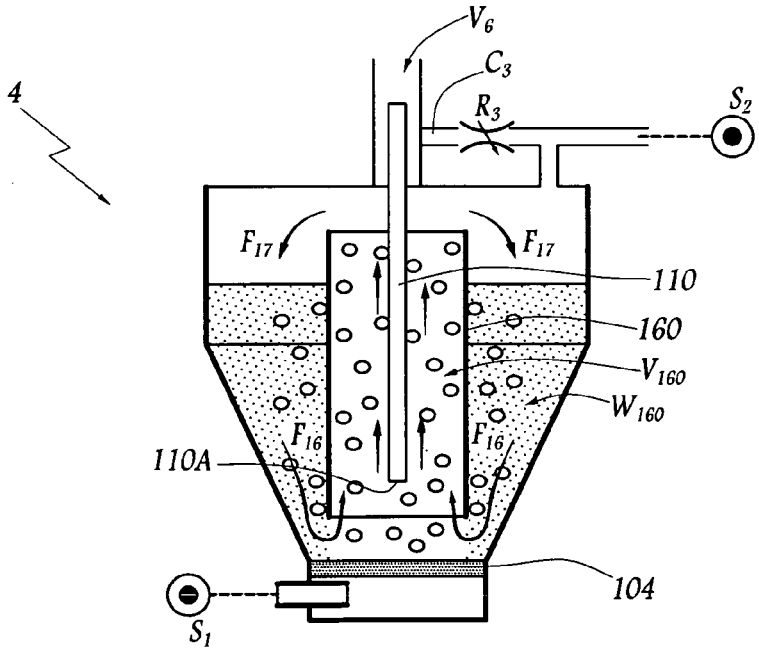
FIG. 9 is a view analogous to FIG. 4 of a sixth embodiment of a system of the invention.

In fifth and sixth embodiments of the invention, shown in FIGS. 8 and 9, components analogous to those of the first embodiment carry the same reference numbers. The pressurized pot 4 of the FIG. 8 embodiment has a downwardly converging wall 103 and its bottom 101 is open and faces a porous plate 104 for fluidizing the coating powder in the pressurized pot. The porous plate is supplied from a compressed air supply $S_1$ and a compressed air supply $S_2$ supplies the volume $W_4$ of the pot 4 that is not occupied by the fluidized powder. A constriction $R_3$ is provided in a pipe $C_3$ that discharges into a dip tube 110 in the vicinity of its upper end 110B, air from the pipe $C_3$ being mixed with the fluidized powder mixture from the tube 110 in a mixing chamber of internal volume $V_6$.

The reservoir 4 is equipped with a vibrator 109 and a weighing system 150 for continuously determining the weight of powder contained in the reservoir. The weighing system sends a signal $\Sigma_1$ to a control unit U of the installation incorporating the reservoir 4. It is therefore possible to monitor the consumption of a sprayer supplied from the reservoir 4 by comparing the weight of the powder at the start and the end of application. It is also possible to monitor the flowrate of powder consumed by the sprayer by integrating, over a shorter or longer time period, the variations in the weight of the powder detected by the weighing system.

A cylindrical baffle 160 is supported inside the reservoir 4 by non shown lugs bearing on the wall 103. The baffle 160 is cylindrical, of circular section and concentric with the tube 110. It delimits two volumes in the interior volume $V_4$ of the reservoir 4, namely a volume $V_{160}$ in the form of a column inside the baffle 160 and a volume $W_{160}$ inside the reservoir and surrounding the baffle 160.

The plate 104 is disk-shaped with a radius similar to the inside radius of the baffle 160. The lower edge 160A of the baffle 160 is at a non-zero height $h_{160}$ relative to the bottom 101. Fluidizing air passing through the plate 104, as shown by the arrow $F_2$, creates a fluidized powder bed $L_4$ in the volume $V_{160}$, the bed $L_4$ being supplied continuously with coating powder stored in non-fluidized form in the volume $W_{160}$ and flowing under its own weight towards the centre of the plate 104. The arrows $F_{16}$ indicate path of the coating powder to be fluidized from the volume $W_{160}$ to the volume $V_{160}$.

The air flowrate through the plate 104 is adjusted so that the bed $L_4$ extends to the upper edge 160B of the baffle 160, a portion of the coating powder overflowing under its own weight towards the volume $W_{160}$, as indicated by the arrow $F_{17}$.

The height $h_4$ of the fluidized bed $L_4$ above the lower end 110A of the tube 110 is therefore constant to the extent that the height $H_4$ of the fluidized bed is itself constant. This prevents fluctuations in the quantity of coating powder directed to the mouth 110A of the tube 110.

In other words, the baffle 160 maintains in the reservoir 4 a column $L_4$ of fluidized powder of constant or virtually constant height $H_4$, despite consumption of the powder and despite the fact that the reservoir is not replenished during application of the powder. The volume $W_{160}$ provides in the reservoir 4 a reserve of powder to be fluidized that compensates the consumption of the powder.

A vibrator 109 is fitted in the lower portion of the reservoir 4 to facilitate movement of the powder to be fluidized in the direction of the arrows $F_{16}$.

The FIG. 9 embodiment is similar to that of FIG. 8. The same references are used to designate the same components and only differences compared to the FIG. 8 embodiment are explained here. The porous plate 104 of the reservoir 4 has an area greater than the section of the interior volume of the baffle 160, which enables fluidization of the coating powder in the volume $V_{160}$ and partial fluidization thereof in the volume $W_{160}$. This facilitates supplying the volume $V_{160}$ with coating powder to be fluidized, as shown by the arrows $F_{16}$, which makes it possible to dispense with the vibrator 109 of the FIG. 8 embodiment.

Other means may be provided to maintain a predetermined height of fluidized coating powder above the mouth 110A of the tube 110. For example, means for manually or automatically adjusting the position of the tube 110 relative to the lid of the pressurized pot may be provided so that the lower end 110A is immersed to a substantially constant height $h_4$ in the fluidized bed $L_4$. It is equally possible to maintain the total height $H_4$ of the fluidized powder bed $L_4$ by maintaining the overall quantity of fluidized coating powder in the reservoir substantially constant, the reservoir being supplied with the powder continuously or virtually continuously.

A weighing system may also be used with the reservoir of the FIG. 9 embodiment, as in the embodiments of FIGS. 1 to 7.

Using a weighing system like the weighing system 150 supplies information as to the weight of the powder in the reservoir for estimating the height of fluidized powder and to ensure filling of the reservoir to a maximum fluidized powder height that in practice corresponds to a maximum weight of powder that the reservoir is able to contain. This kind of weighing system also enables real-time estimation of the changing height of the fluidized powder for automatically correcting the flowrate supplied to the sprayer by the system, if necessary. This compensates any drift in the flowrate resulting from a variation in the height of fluidized powder that may occur in the first four embodiments of the system that have no baffle like the baffle 160.

The invention has been described in applications to a coating powder installation and to transporting agrofood powders. It is not limited to those applications, however, although the application to coating powder installations is highly advantageous. In particular, the invention may be used in the pharmaceutical field to transport medication in powder form or in the agriculture field to transport herbicides, fungicides or fertilizers in powder form.

The nature of the fluidizing gas and the pressurizing gas may be adapted as a function of the nature of the powder to be transported.

In the first two embodiments, the constriction $R_3$ is variable. It may be fixed, however. Controlling the total flowrate of gas entering the reservoir and the flowrate of the gas passing through the constriction then enables the flowrate of powder taken up from the reservoir to be controlled. Where appropriate, the constriction may be changed as a function of the characteristics of the powder to be transported and the characteristics of the installation downstream of the mixing chamber.

The constriction of the third and fourth embodiments may be adjustable.

It may consist of a tube of relatively small inside diameter, a diaphragm or any other appropriate means.

Regardless of the embodiment concerned, the constriction in or constituting the pipe for supplying gas to the mixing chamber may be adjustable or fixed.

In practice, a fixed constriction facilitates control of the powder flowrate because it is a relatively simple matter to govern the flowrate and/or the pressure of the gas for pressurizing the reservoir, for example using a solenoid valve. Furthermore, as the gas passing through this kind of constriction may be lightly laden with coating powder particles, especially in the case of the FIG. 4 installation, it is preferable for the constriction to have a simple shape, free of entrapment regions.

In practice, to enable separation of powder flowrate control and fluidization, the flowrate of the fluidizing gas may be negligible compared to the flowrate of the gas for pressurizing the reservoir. In particular, this means that the coating powder may remain in the fluidized bed form pending pumping it into the reservoir, without the air flowrate necessary for producing this fluidization being sufficient to create a head loss across the constriction and cause pumping of the powder.

In the invention as shown, in certain items of equipment all of the powder is fluidized. The invention applies equally to the situation in which only a portion of the powder is fluidized. Furthermore, all the embodiments of the invention include a system known in the art for supplying the reservoir with powder, either continuously or sequentially. A simple option is for the lid of the reservoir to be removed periodically and powder to be tipped into the reservoir by an operative.

The invention has been described using separate air supplies $S_1$, $S_2$ and/or $S_3$. Those supplies are in practice supplied from a common main network and pressure or flowrate regulating means are provided on the upstream side of the supplies $S_1$, $S_2$ and/or $S_3$ so that they can be managed independently. Two supplies or all three supplies could instead be combined.

Figure 10:
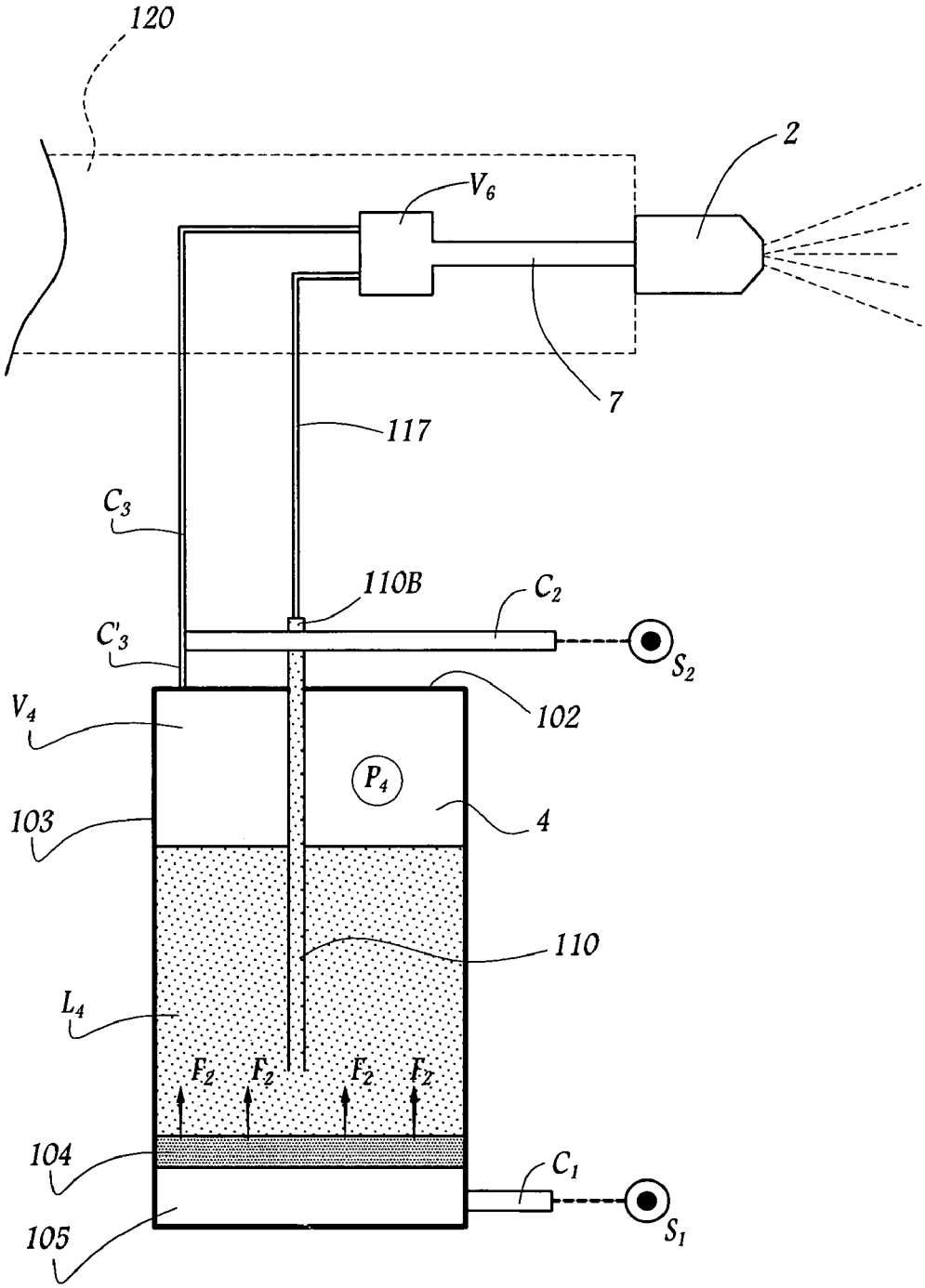
FIG. 10 is a view analogous to FIG. 4 of a seventh embodiment of a system of the invention.

In a seventh embodiment, shown in FIG. 10, components analogous to those of the first embodiment carry the same references. The pressurized pot 4 of this embodiment is used to supply a sprayer 2 of coating powder mounted on the mobile arm 120 of a multi-axis robot. The sprayer 2 could instead be mounted on any type of support, in particular the arm of reciprocator.

The pressurized pot 4 has a cylindrical wall 103 and its internal volume is divided by a porous plate 104 into a distribution chamber 105 and a volume for producing a fluidized bed $L_4$ of coating powder. The chamber 105 is supplied with compressed air at a controlled pressure from a compressed air supply $S_1$, the compressed air passing through the plate 104, as shown by the arrows $F_2$, to fluidize the bed $L_4$.

A tube 110 dips from the lid 102 of the pot 4 into the fluidized bed $L_4$ and draws off a portion of the powder, as explained above. The tube 110 is connected at the top to a flexible hose 117 that extends from the upper end 110B of the tube 110 to a volume $V_6$ defined inside the arm 120 in which the dense phase powder passing through the tube 110 and the hose 117 is mixed with additional air. To this end, the volume $V_6$ is supplied via a pipe $C_3$ of relatively small diameter from a pipe $C_2$ connected to a second compressed air supply $S_2$.

The pipe $C_2$ is also connected to the interior volume $V_4$ of the pot 4 above the fluidized bed $L_4$ by a pipe section $C'_3$.

Downstream of the volume $V_6$, the coating powder mixed with air flows in a hose 7 supplying the sprayer 2.

In practice, the length of the hose 117 may be of the order of 6 to 8 m and the length of the hose 7 greater than 10 cm and less than 2 m. The length of the hose 7 could nevertheless be increased to up to 50% of the total length of the flow path between the pot 4 and the sprayer 2.

The pipe $C_3$ constitutes means for continuously supplying pressurizing gas from the supply $S_2$ to the mixing chamber formed by the volume $V_6$. Given its length and its diameter, which in practice is less than 5 mm, the pipe $C_3$ induces in the flow of air from the supply $S_2$ a head loss caused by the constriction that it forms.

According to an aspect of the invention that is not shown, the pipe $C_3$ could also be equipped with a variable constriction like the constriction $R_3$ in the embodiments shown in FIGS. 4, 8 and 9.

Compared to the first embodiment described, the seventh embodiment corresponds to a situation in which a dense coating powder is transported over a relatively great distance, namely the length of the hose 117, and, following dilution, over a relatively short distance, namely the length of the hose 7. In all other respects this embodiment is similar to the first embodiment.

The features of the various embodiments of the present invention may be combined with each other.

The invention claimed is:

1. A system for continuously metering and transporting powder, said system comprising: a closed reservoir containing a mass of the powder to be transported;

means for fluidizing at least a portion of the powder in said reservoir; a tube extending vertically into the fluidized powder, said tube having a lower end in the fluidized powder and an upper end located above the fluidized powder for discharging fluidized powder to the outside of said reservoir;

first supply means for supplying pressurizing gas to an internal volume of said reservoir above the fluidized powder;

second supply means for continuously supplying pressurizing gas; a mixing chamber having upstream and downstream ends and connected to receive pressurizing gas from said second supply means for mixing said pressurizing gas from said second supply means with the fluidized powder leaving said tube, said second supply means presenting a constriction to the flow of the pressurizing gas to said mixing chamber; and a hose for transporting the powder mixed with said pressurizing gas supplied by said second supply means, said hose being connected to the downstream end of said mixing chamber, wherein, during operation of said system, a pressure difference exists between said lower end and said upper end of said tube, which pressure difference controls the mass flow rate of fluidized powder from said tube, and said constriction produces an adjustable head loss in the flow of gas to said mixing chamber, which head loss controls the pressure difference, and wherein said second supply means are supplied with gas directly from said first supply means.

2. A system according to claim 1, characterized in that said constriction is adjustable to adjust the head loss induced in the flow of gas in said second supply means.

3. A system according to claim 1, characterized in that said constriction is fixed and produces a head loss in the flow of gas to said mixing chamber, and the head loss induced in the flow of gas in said second supply means to said mixing chamber is controlled primarily by controlling the gas flowrate through said constriction.

4. A system according to claim 1, characterized in that said mixing chamber is immediately downstream of said tube.

5. A system according to claim 4, characterized in that said mixing chamber has a length in the direction of flow of the powder that is more than three times its inside diameter.

6. A system according to claim 4, characterized in that said mixing chamber has a length in the direction of flow of the powder that is of the order of ten times its inside diameter.

7. A system according to claim 1, characterized in that said second supply means comprise an annular volume around said tube and below the upper end of said tube.

8. A system according to claim 1, characterized in that said second supply means comprise a first pipe extending between said first supply means and said mixing chamber.

9. A system according to claim 1, characterized in that said system comprises third supply means for supplying said mixing chamber with additional diluting gas, said third supply means being separate from said second supply means and adapted to be controlled independently.

10. A system according to claim 1, characterized in that said second supply means comprise a passage for supplying said gas to said mixing chamber, and at least one of said mixing chamber and said passage is provided with a raised pattern for improving the mixing of the gas and the coating powder by stirring or a vortex effect.

11. A system according to claim 1, characterized in that said second supply means comprise a first pipe extending between the internal volume of the reservoir above the fluidized powder and said mixing chamber.

12. A coating powder sprayer installation (I) comprising a coating powder sprayer and a system according to claim 1 for supplying said sprayer with coating powder.

13. A method to supply a sprayer with coating powder, comprising: providing the system according to claim 1;

fluidizing at least a portion of the powder in the reservoir;

discharging fluidized powder out of the reservoir through said tube; pressurizing an internal volume of the reservoir above the fluidized powder with a pressurizing gas under pressure supplied by said first supply means; supplying pressurized gas under pressure from said second supply means to said mixing chamber for mixing said pressurized gas under pressure with the fluidized powder leaving said tube; and transporting the powder mixed with said gas through said hose.

* * * * *